US009682270B2

(12) United States Patent
Leone

(10) Patent No.: US 9,682,270 B2
(45) Date of Patent: Jun. 20, 2017

(54) APPARATUS FOR EXERCISE

(71) Applicant: Massimo A. Leone, Penfield, NY (US)

(72) Inventor: Massimo A. Leone, Penfield, NY (US)

( * ) Notice: Subject to any disclaimer, the term of this patent is extended or adjusted under 35 U.S.C. 154(b) by 0 days.

(21) Appl. No.: 14/682,330

(22) Filed: Apr. 9, 2015

(65) Prior Publication Data

US 2015/0290486 A1 Oct. 15, 2015

Related U.S. Application Data

(60) Provisional application No. 61/977,317, filed on Apr. 9, 2014.

(51) Int. Cl.

| | |
|---|---|
| ***A63B 21/068*** | (2006.01) |
| ***A63B 21/00*** | (2006.01) |
| ***A63B 26/00*** | (2006.01) |
| ***A63B 21/002*** | (2006.01) |
| ***A63B 23/02*** | (2006.01) |
| ***A63B 23/12*** | (2006.01) |

(52) U.S. Cl.

CPC ..... *A63B 21/068* (2013.01); *A63B 21/0023* (2013.01); *A63B 21/00072* (2013.01); *A63B 21/4031* (2015.10); *A63B 21/4034* (2015.10); *A63B 21/4035* (2015.10); *A63B 23/0216* (2013.01); *A63B 23/12* (2013.01); *A63B 23/1236* (2013.01); *A63B 2208/0242* (2013.01); *A63B 2208/0252* (2013.01); *A63B 2208/0257* (2013.01); *A63B 2225/09* (2013.01); *A63B 2225/093* (2013.01)

(58) Field of Classification Search

CPC ..... A63B 21/068; A63B 2026/006; A63B 21/00072; A63B 21/0023; A63B 21/4031; A63B 21/4034; A63B 21/4035; A63B 23/12; A63B 23/1236; A63B 23/0216; A63B 2208/0242; A63B 2208/0252; A63B 2208/0257; A63B 2225/09; A63B 2225/093

USPC ..... 482/137, 144, 908; 606/244, 245

See application file for complete search history.

(56) References Cited

U.S. PATENT DOCUMENTS 3,570,479 A * 3/1971 Horn ..... A61H 1/0218 482/145

4,730,829 A * 3/1988 Carlson ..... A63B 21/0052 482/137

(Continued)

*Primary Examiner* — Joshua Lee

(74) *Attorney, Agent, or Firm* — Timothy W. Menasco, Esq.; Harter Secrest & Emery LLP

(57) ABSTRACT

An apparatus for exercise, the apparatus including a support frame having a pivot point and a support bed pivotally connected to the support frame at the pivot point and moveable between a first substantially vertical position to a plurality of second horizontal or declined positions. The apparatus further includes a handle grip assembly connected to the support bed for movement with the support bed relative to the support frame, the handle grip assembly having a first grip and a spaced apart second grip moveable between a narrow position and a plurality of spaced configurations relative to a longitudinal axis of the support bed. The apparatus also includes an inclined arm pivotally connected between the support bed and the support frame and effectively defining a first effective length between the support bed and support frame and a different plurality of second effective lengths between the support bed and the support frame.

14 Claims, 2 Drawing Sheets

(56) References Cited

U.S. PATENT DOCUMENTS 4,915,101 A * 4/1990 Cuccia ..... A61H 1/0229 606/244
5,582,565 A 12/1996 Soria
5,674,168 A 10/1997 Wilkinson
5,718,660 A * 2/1998 Chen ..... A61H 1/0218 482/144
5,840,001 A * 11/1998 Schedel ..... A61H 1/0218 482/130
5,928,119 A 7/1999 Dinkel
5,971,902 A * 10/1999 Robertson ..... A61H 1/0218 482/142
6,030,325 A * 2/2000 Ottoson ..... A61H 1/0218 482/144
7,060,014 B2 6/2006 Bergman et al.
7,125,371 B2 10/2006 Henderson
7,134,989 B2 * 11/2006 Liao ..... A61H 1/003 482/142
7,367,928 B2 5/2008 Storch
7,658,702 B1 2/2010 Harms
8,012,073 B2 * 9/2011 Barnett ..... A63B 21/068 482/142
8,177,695 B2 * 5/2012 Dellino ..... A63B 21/00065 482/140
8,235,877 B2 * 8/2012 Boren ..... A63B 26/00 482/142
9,211,440 B2 * 12/2015 Lagree ..... A63B 24/0087
2003/0153442 A1 * 8/2003 Kuo ..... A61H 1/0218 482/144
2004/0157713 A1 8/2004 Kweon
2007/0043308 A1 * 2/2007 Lee ..... A61H 1/0237 601/34
2008/0045390 A1 * 2/2008 Harms ..... A63B 23/12 482/141
2013/0150219 A1 * 6/2013 Chang ..... A61H 1/0229 482/144
2014/0066276 A1 * 3/2014 Hornback ..... A63B 21/068 482/145

* cited by examiner

APPARATUS FOR EXERCISE

FIELD OF THE INVENTION

Exemplary embodiments of the present disclosure relate to an apparatus for exercise. The present disclosure relates more specifically to providing an apparatus for weighted and bodyweight exercise.

BACKGROUND OF THE INVENTION

Physical exercise includes any bodily activity that enhances or maintains physical fitness and overall health and wellness. It is performed for various reasons including strengthening muscles, honing athletic skills, weight loss or maintenance, as well as for the purpose of enjoyment.

Bodyweight exercises are strength training exercises that do not require free weights. A practitioner's own weight provides the resistance for the movement. Movements such as the push-up, the pull-up, and the sit-up are some of the most common bodyweight exercises.

Because they do not require weights, bodyweight exercises are the ideal choice for individuals who are interested in fitness but do not have access to equipment. Weights may be incorporated into bodyweight exercises to increase the difficulty. While some exercises do require some sort of equipment, the majority of bodyweight exercises require none. For those exercises that do require equipment of some kind, a substitute can usually be improvised.

Bodyweight exercises, compared to weight lifting, often require much more flexibility and balance in order to perform repetitions. Many bodyweight exercises can be progressed or regressed to meet the individual's need. This progression/regression strategy allows nearly all levels of fitness to participate. Bodyweight training can be used effectively to strengthen the core muscles with the addition of speed or unstable surfaces (such as a stability ball) as well as exercise variations that limit the motion (such as extra wide push-ups or wide pull-ups).

Bodyweight exercises use the practitioner's own weight to provide the resistance for the movement. This means that the weight being lifted is never greater than the weight of one's own body. This can make it difficult to achieve a level of intensity that is near their one rep maximum, which is desirable for strength training. Bodyweight exercises can be increased in intensity by including additional weights (such as wearing a weighted vest or holding a barbell, kettlebell, sandbell or plate during a sit up) or by altering the exercise to put one's self at a leverage disadvantage (such as elevating the feet, hanging from straps to change leverage, using one limb, and incorporating isometrics).

Bodyweight exercises can also be modified to decrease the intensity. For instance, a practitioner unable to perform a single push-up may perform them with their knees on the ground, or replace pull-ups with bodyweight rows.

SUMMARY OF THE INVENTION

In view of the foregoing, it is an object of the present invention to provide an apparatus for exercise.

A first exemplary embodiment of the present disclosure provides an apparatus for bodyweight exercise. The apparatus includes a support frame having a pivot point and a support bed pivotally connected to the support frame at the pivot point and moveable between a first substantially vertical position to a plurality of second vertical, horizontal or declined positions. The apparatus further includes a handle grip assembly connected to the support bed for movement with the support bed relative to the support frame, the handle grip assembly having a first grip and a spaced apart second grip moveable between a narrow position and a plurality of spaced configurations relative to a longitudinal axis of the support bed. The apparatus further includes an inclined arm pivotally connected between the support bed and the support frame and effectively defining a first effective length between the support bed and support frame and a different plurality of second effective lengths between the support bed and the support frame.

A second exemplary embodiment of the present disclosure provides an apparatus for exercise. The apparatus includes a support frame having a pivot point, and a support bed pivotally and moveably connected to the support frame at the pivot point. The apparatus further includes a handle grip assembly connected to the support bed for movement with the support bed relative to the support frame, the handle grip assembly having a first grip and a spaced apart second grip moveable between a narrow position and a plurality of spaced configurations relative to a longitudinal axis of the support bed. The apparatus also includes an inclined arm located between the support bed and the support frame for movement with the support bed relative to the support frame, the inclined arm pivotally connected to the support bed and slidably connected to the support frame, the inclined arm effectively defining a first effective length between the support bed and the support frame and a different plurality of second effective lengths between the support bed and the support frame, wherein movement of the inclined arm to the first effective length and the different plurality of second effective lengths correspond to movement of the support bed relative to the support frame between a first substantially vertical position to a plurality of second vertical, horizontal or declined positions.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

DETAILED DESCRIPTION OF THE INVENTION

Exemplary embodiments of the present disclosure provide an exercise device that can selectively use part, all or more than a user's body weight to exercise.

Figure 1:
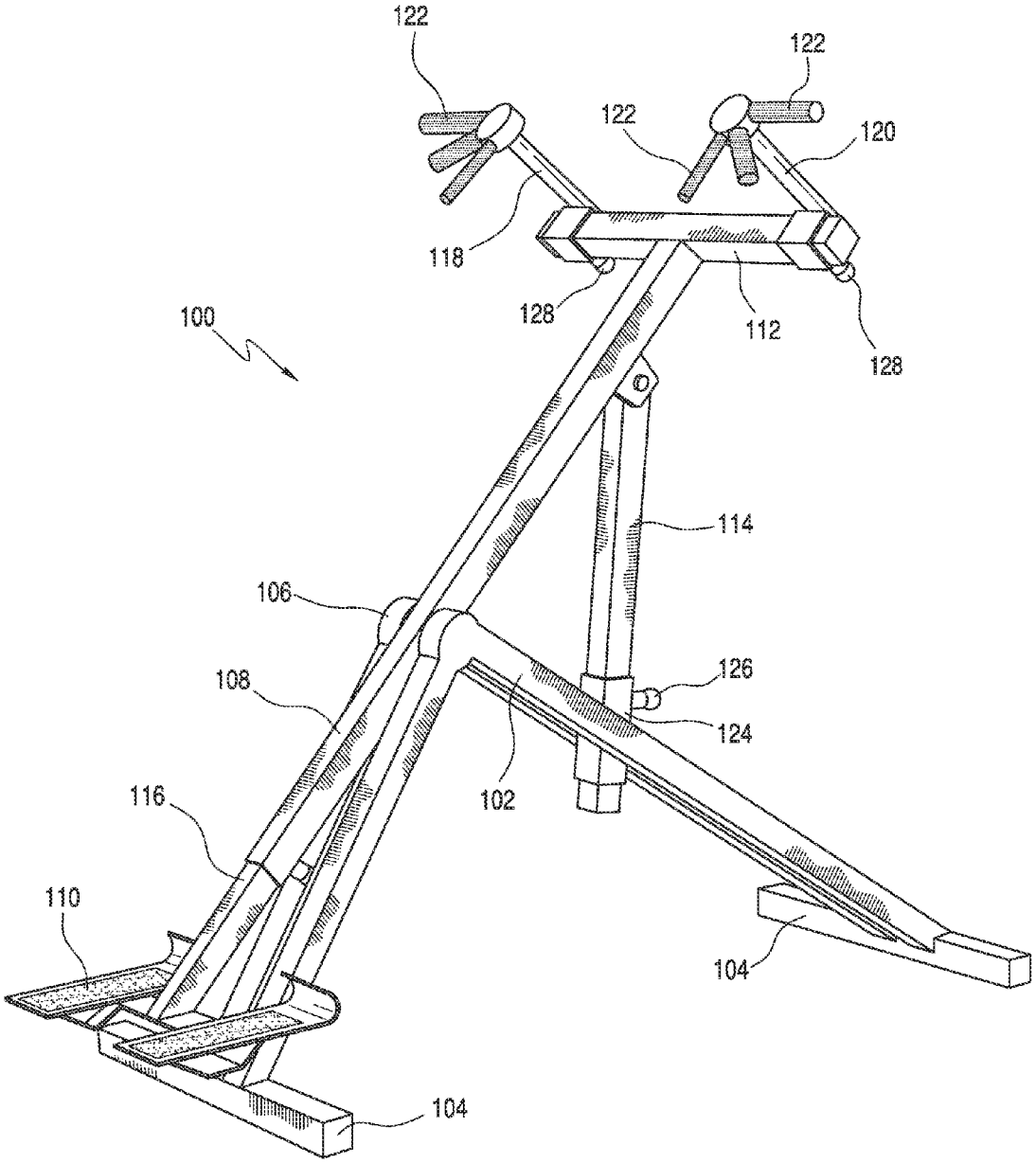
FIG. 1 illustrates a perspective view of an apparatus in accordance with exemplary embodiments of this disclosure.

Exemplary embodiments of the present disclosure include an exercise machine as shown in FIG. 1. FIG. 1 depicts an exercise device 100, which includes a support stand 102 having at least a pair of feet 104 and an elevated pivot point 106. A support frame 108 is pivotally connected to the support stand 102 or support bed and movable between a first inclined position and a plurality of second vertical, horizontal or declined positions. The support frame 108 has a foot rest 110, foot bearing or foot receiving area, such as formed by a pair of foot supports. The support frame 108 also includes a spaced apart handle grip assembly 112. The handle grip assembly 112 can be adjustable among a plurality of positions generally described as a narrow position to a wide position.

Exemplary embodiments of device 100 are made out of metals, metal alloys, aluminum alloys, composites, plastics, wood, or a combination of all of these elements. Exemplary embodiments of device 100 provide that it can be made out of any combination of materials that allow it be both rigid and able to support a person's body weight.

An incline arm 114 is pivotally connected to the support frame 108 and the support stand 102 at a position spaced from the pivotal interconnection of the support frame 108 and the support stand 102. By changing the effective length of the incline arm 114 between the pivotal connections with the support frame 108 and the support stand 102, the angle of inclination of the support frame 108 relative to the ground or floor can be altered. In one configuration, the inclination of the incline arm 114 is movable between a substantially vertical position to a declined position. The decline position of the incline arm 114 in exemplary embodiments is at approximately 30 to 60 degrees below parallel to the floor. It can be appreciated that exemplary embodiments of incline arm 114 provide that it can be moved and set at numerous indexing positions between substantially vertical to horizontal to substantially declined and anything in between.

The support frame 108 may include of a pair of telescoping members 116 thereby allowing selected variation of distance between the foot rest 110 and the handle grip assembly 112. Exemplary embodiments of device 100 include any of a variety of telescoping or extendable constructions.

The support frame 108 in exemplary embodiments is pivotally connected to the support stand 102 such that the support bed can rotate relative to the support stand 102. In exemplary embodiments of device 100, the handle grip assembly 112 and the foot rest 110 provide a physical rotational limit blocking the complete rotation of support frame 108 in both a clockwise and counterclockwise direction.

The handle grip assembly 112 includes a left grip 118 and a right grip 120. The left grip 118 and the right grip 120 include a plurality of handles 122 at a variety of predetermined orientations. Exemplary embodiments of the plurality of handles 122 provide that the plurality of handles 122 can be covered by a rubber or foam like material that provides a user with a surface that is both easier for the user to grip and more comfortable. In one configuration, the transverse spacing of the left grip 118 and the right grip 120 from the longitudinal axis of the support bed is adjustable. Exemplary embodiments of handle grip assembly 112 provide for handle grip assembly 112 to have notches or holes (not shown in FIG. 1) that allow the left grip 118 and the right grip 120 to selectively lock into a desired position through the use of a locking mechanism, such as sliding pins 128.

Exemplary embodiments of sliding pin 128 provide that it can be released so as to allow the left grip 118 and the right grip 120 to move freely along handle grip assembly 112. Sliding pins 128 may also lock left grip 118 and right grip 120 into place using notches or holes (not shown in FIG. 1) on handle grip assembly 112.

Exemplary embodiments of device 100 further provide that the relative height of the left grip 118 and the right grip 120 in relation to handle grip assembly 112 and support stand 108 is adjustable. The height of left grip 118 and the right grip 120 relative to handle grip assembly 112 may be selectively adjusted through the use of a sliding pin (not shown in FIG. 1) that can selectively engage holes or notches that are located along the vertically extended portion of left grip 118 and right grip 120.

The inclined arm 114 can include one end pivotally connected to the support frame 108 wherein the other end is slightably received within a pivoting coupling 124, which is pivotally connected to the support stand 102. Thus, as the inclined arm 114 slides relative to the pivoting coupling 124, the effective length of the inclined arm 114 between the support frame 108 and the support stand 102 is decreased. In short, the inclined arm 114 adjusts the inclination of the support frame 108 relative to the floor.

Exemplary embodiments of pivot coupling 124 include a selective locking mechanism, such as a sliding pin 126 that selectively locks inclined arm 114 to a desired position. In one exemplary embodiment, inclined arm 114 includes notches or holes along its length (not shown in FIG. 1) that can hold or maintain sliding pin 126. Sliding pin 126 can be pulled to allow inclined arm 114 to slide freely within pivot coupling 124 and can be released or compressed into a notch or hole of inclined arm 114 to selectively lock the location of inclined arm 114. Sliding pin 126 thus maintains the incline or decline of support frame 108 relative to the floor. Exemplary embodiments of inclined arm 114 provide for numerous notches or holes along its length such that sliding pin 126 is able to selectively lock the location of inclined arm 114 at various degrees of incline and decline. For example, if inclined arm 114 included 20 notches or holes, inclined arm 114 would thus have 20 different indexing positions that would allow inclined arm 114 to move to various degrees of incline and decline.

Provided below is an example of how device 100 may be used when the support frame 108 is in the inclined position as shown in FIG. 1. First, the user steps onto the foot rests 110 and places his/her hands upon the corresponding grips 122 within the handle grip assemblies 112. The user then allows his/her body to pass from a vertical position with his/her arms substantially straight to substantially parallel to the slightly inclined support frame 108 as the arms are bend. The user can then extend his/her arms pushing the torso of the user from the slightly inclined position to a substantially vertical position.

Figure 2:
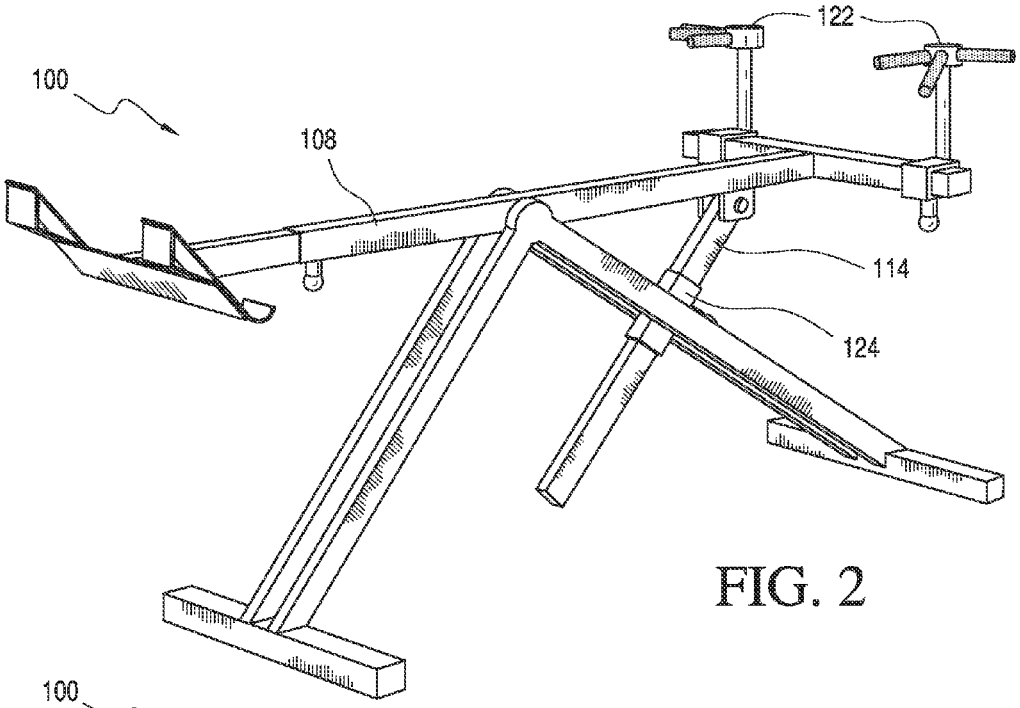
FIG. 2 shows a different arrangement of an apparatus in accordance with exemplary embodiments of this disclosure.

If the user desires greater resistance, the effective length of the inclined arm 114 can be is shortened, such as by sliding the inclined arm 114 relative to the pivoting coupler 124 so that the support frame 108 is, for example, substantially parallel to the ground. FIG. 2 depicts a configuration of device 100 wherein support frame 108 is substantially parallel to the floor. As is evident, the amount of the inclined arm 114 between support frame 108 and support stand 102 is much less than in FIG. 1. The user then places their feet on the foot rests 110 and hands on the corresponding handles 122 and performs a pushup movement.

Figure 3:
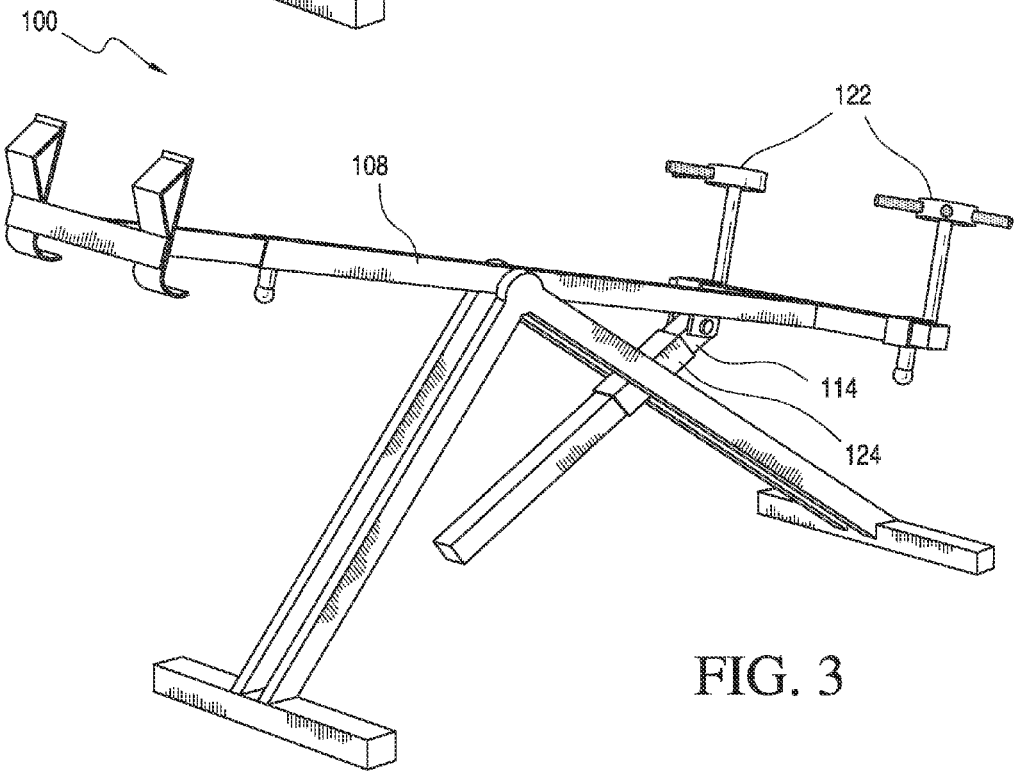
FIG. 3 depicts an alternative arrangement of an apparatus in accordance with exemplary embodiments of this disclosure.

Referring to FIG. 3, shown is a configuration of device 100 when inclined arm 114 is completely shortened by sliding the inclined arm 114 relative to the pivoting coupler 124 so that the support frame 108 is in a declined position relative to the floor. When used, the user again places their feet on the feet rests 110 and the hands on the grips 122. In this configuration, the users body is then slightly declined or the feet are at or higher than the head. A pushup motion is then repeated until a decided amount of exercise is obtained.

Exemplary embodiments of device 100 may also be used for other types of exercise. Exemplary embodiments of device 100 allow a user to lie with their head beneath handle grip assembly 112 while the support frame 108 is in a parallel or decline position relative to the floor as shown in FIG. 2 or FIG. 3. The user can then grip handle grip assembly 112 with their hands and pull their torso and back off the ground toward handle grip assembly 112 in a rowing type motion. The user can then lower their torso and back to the ground. This series of motions can then be repeated at the user's desire.

The invention claimed is:

1. An apparatus comprising:

a support frame having a pivot point;

a support bed pivotally connected to the support frame at the pivot point and moveable between a first substantially vertical position to a plurality of second vertical, horizontal or declined positions;

a handle grip assembly connected to the support bed for movement with the support bed relative to the support frame, the handle grip assembly having a first grip and a spaced apart second grip moveable between a narrow position and a plurality of spaced configurations horizontally perpendicular relative to a longitudinal axis of the support bed, wherein the first grip and the spaced apart second grip are movable to selectively adjust a height of the first grip and the spaced apart second grip vertically perpendicular relative to the handle grip assembly and the longitudinal axis of the support bed; and an inclined arm pivotally connected between the support bed and the support frame and effectively defining a first effective length between the support bed and support frame and a different plurality of second effective lengths between the support bed and the support frame.

2. The apparatus according to claim 1, wherein the handle grip assembly includes at least two projecting handles.

3. The apparatus according to claim 2, the apparatus further comprising a foot rest assembly connected to the support bed for movement with the support bed relative to the support frame, the foot rest assembly having a first foot rest and a second foot rest, wherein the first foot rest and the second foot rest are moveable from a short position to a plurality of long positions relative to the support bed.

4. The apparatus according to claim 3, wherein the first grip and the second grip comprise a lock for selectively locking the first grip and the second grip in the narrow position and the plurality of spaced configurations relative to a longitudinal axis of the support bed.

5. The apparatus according to claim 4, wherein the inclined arm comprises a lock for selectively locking the inclined arm in the first effective length between the support bed and support frame and the different plurality of second effective lengths between the support bed and the support frame.

6. The apparatus according to claim 5, wherein the foot rest assembly comprises a lock for selectively locking the foot rest assembly in the short position to the plurality of long positions relative to the support bed.

7. The apparatus according to claim 6, the apparatus further comprising feet fixedly connected to the support frame.

8. An apparatus comprising:

a support frame having a pivot point;

a support bed pivotally and moveably connected to the support frame at the pivot point;

a handle grip assembly connected to the support bed for movement with the support bed relative to the support frame, the handle grip assembly having a first grip and a spaced apart second grip moveable between a narrow position and a plurality of spaced configurations horizontally perpendicular relative to a longitudinal axis of the support bed, wherein the first grip and the spaced apart second grip are movable to selectively adjust a height of the first grip and the spaced apart second grip vertically perpendicular relative to the handle grip assembly and the longitudinal axis of the support bed; and an inclined arm located between the support bed and the support frame for movement with the support bed relative to the support frame, the inclined arm pivotally connected to the support bed and slidably connected to the support frame, the inclined arm effectively defining a first effective length between the support bed and the support frame and a different plurality of second effective lengths between the support bed and the support frame, wherein movement of the inclined arm to the first effective length and the different plurality of second effective lengths correspond to movement of the support bed relative to the support frame between a first substantially vertical position to a plurality of second vertical, horizontal or declined positions.

9. The apparatus according to claim 8, wherein the handle grip assembly includes at least two projecting handles.

10. The apparatus according to claim 9, the apparatus further comprising a foot rest assembly connected to the support bed for movement with the support bed relative to the support frame, the foot rest assembly having at least one foot rest, wherein the at least one foot rest is moveable from a short position to a plurality of long positions relative to the support bed.

11. The apparatus according to claim 10, wherein the first grip and the second grip comprise a lock for selectively locking the first grip and the second grip in the narrow position and the plurality of spaced configurations relative to a longitudinal axis of the support bed.

12. The apparatus according to claim 11, wherein the inclined arm comprises a lock for selectively locking the inclined arm in the first effective length between the support bed and support frame and the different plurality of second effective lengths between the support bed and the support frame.

13. The apparatus according to claim 12, wherein the foot rest assembly comprises a lock for selectively locking the foot rest assembly in the short position to the plurality of long positions relative to the support bed.

14. The apparatus according to claim 13, the apparatus further comprising feet fixedly connected to the support frame.

* * * * *